US007048554B2

(12) United States Patent
Wang

(10) Patent No.: US 7,048,554 B2
(45) Date of Patent: May 23, 2006

(54) ELECTRICAL CONNECTOR WITH IMPROVED SIGNAL TRANSMISSION EFFECT

(75) Inventor: Wei-Che Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/102,033

(22) Filed: Apr. 7, 2005

(65) Prior Publication Data

US 2005/0287839 A1 Dec. 29, 2005

(30) Foreign Application Priority Data

Jun. 28, 2004 (CN) ..... 2004 2 0623184 U

(51) Int. Cl.
*H01R 12/00* (2006.01)

(52) U.S. Cl. ..... 439/79; 439/567; 439/607

(58) Field of Classification Search ..... 439/607, 439/660, 405, 648, 181, 79, 567
See application file for complete search history.

(56) References Cited

U.S. PATENT DOCUMENTS 5,219,294 A * 6/1993 Marsh et al. ..... 439/79
5,567,169 A * 10/1996 McCleerey et al. ..... 439/181
5,921,814 A 7/1999 Maruyama
6,071,151 A 6/2000 Igarashi
6,210,225 B1 * 4/2001 Cai et al. ..... 439/607
6,347,960 B1 * 2/2002 Chen ..... 439/607
6,439,926 B1 * 8/2002 Kuan ..... 439/607
6,638,104 B1 * 10/2003 Hashimoto et al. ..... 439/567
6,709,286 B1 * 3/2004 Korsunsky et al. ..... 439/557
6,736,676 B1 * 5/2004 Zhang et al. ..... 439/607
6,811,439 B1 * 11/2004 Shin-Ting ..... 439/607
6,821,149 B1 * 11/2004 Lai ..... 439/607

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

An electrical connector (1) includes an insulative housing (10) having a mating interface (14) and a number of terminals (30) are received in the insulative housing. The mating portion defines a receiving slot (16) therein. A tongue (150) is defined in the receiving slot, and divides the receiving into a first receiving slot (161) and a second receiving slot (162). The terminals extend to the tongue and a pair of opposite walls (141, 142) in a vertical direction of the mating interface. At least a first block (151) extends vertically from one of side walls into the receiving slot adjacent to the first receiving space.

20 Claims, 6 Drawing Sheets

ELECTRICAL CONNECTOR WITH IMPROVED SIGNAL TRANSMISSION EFFECT

BACKGROUND OF THE INVENTION

1. Field of the Invention

The present invention generally relates to an electrical connector, and particularly to an electrical connector used in portable computer.

2. Description of Prior Arts

With the development of portable computer, the dimension of the portable computer gets more and more smaller so that the computer needs external equipments to meet current requirements. A docking connector is widely used for connecting the external equipments with the portable computer. Normally, the contacts of the docking connector are used for transporting different types of the signals to meet the requirements of the portable computer. Because the docking connector comprises a large amount of contacts, the pitch between the contacts is tiny. As a result, the adjacent contacts, which transport different type of signals, interfere with each other.

For resolving this problem, some spare contacts between the contacts which transport different types of signals are often removed for increasing the contact pitch thereof. Obviously, this design decreases the number of the contacts, therefore, the ability of transporting the signals of the connector is depressed.

Hence, it is desirable to have an improved connector to overcome the above-mentioned disadvantages of the prior art.

BRIEF SUMMARY OF THE INVENTION

Accordingly, it is an object of the present invention to provide an electrical connector having a perfect ability of transmission of signals, and without interference between contacts.

In order to achieve the above-mentioned objects, an electrical connector comprises an insulative housing having a mating interface and a plurality of terminals are received in the insulative housing. The mating interface defines a receiving slot therein. A tongue is defined in the receiving space, and divides the receiving slot into a first receiving slot and a second receiving slot. The terminals extend to the tongue and a pair of opposite walls in a vertical direction of the mating interface. At least a first block extends vertically from one of side walls into the receiving slot adjacent to the first receiving space.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
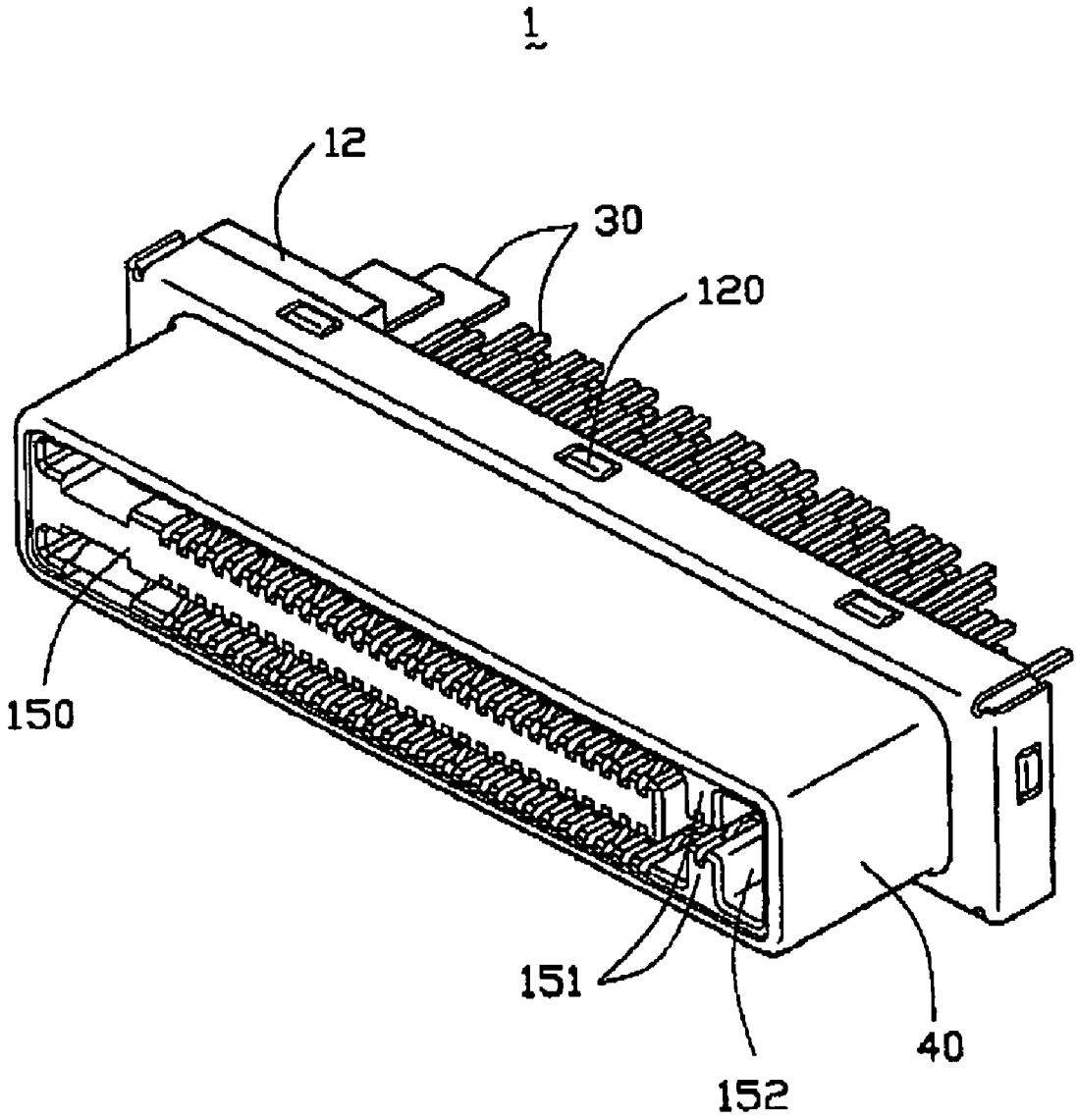
FIG. 1 is a perspective view of an electrical connector in accordance with the present invention.

Reference will now be made to the drawing figures to describe the present invention in detail.

With reference to FIG. 1, an electrical connector 1 in accordance with present invention comprises an insulative housing 10, a plurality of terminals 30 received in the insulative housing 10 and a shell 40 enclosing the insulative housing 10.

Figure 2:
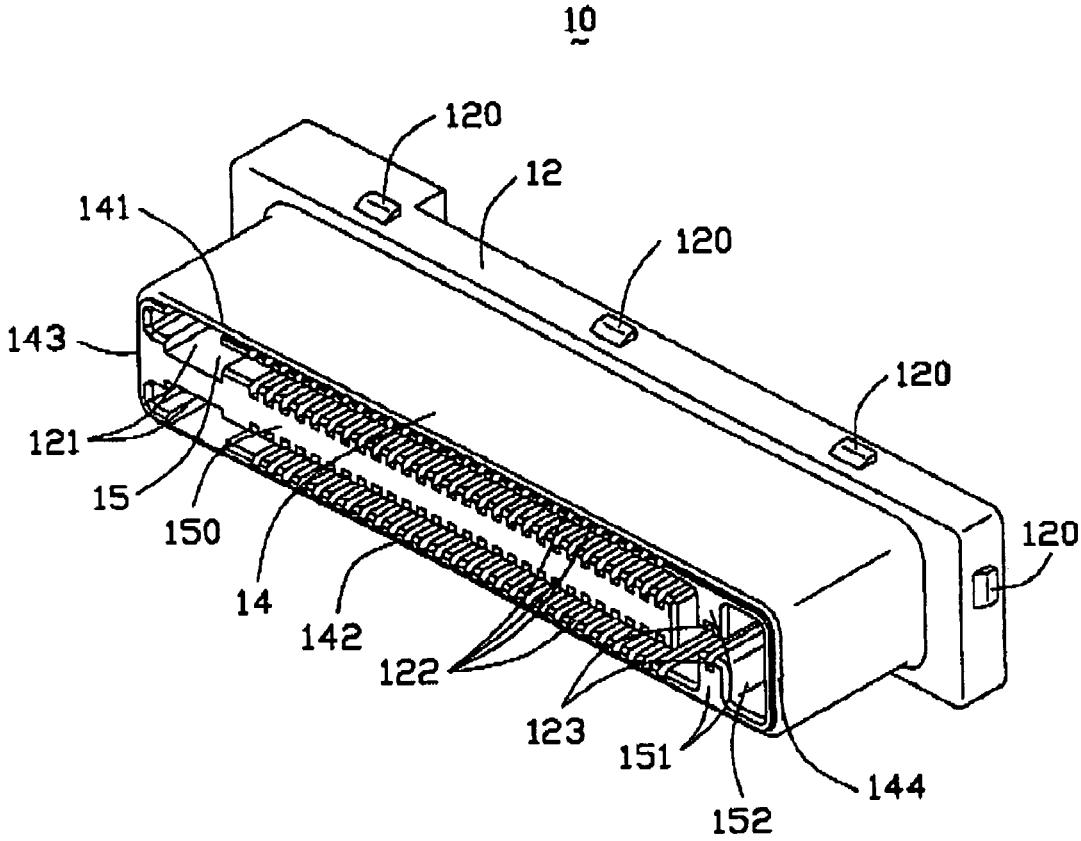
FIG. 2 is a perspective view of an insulative housing of the electrical connector shown in FIG. 1.
Figure 3:
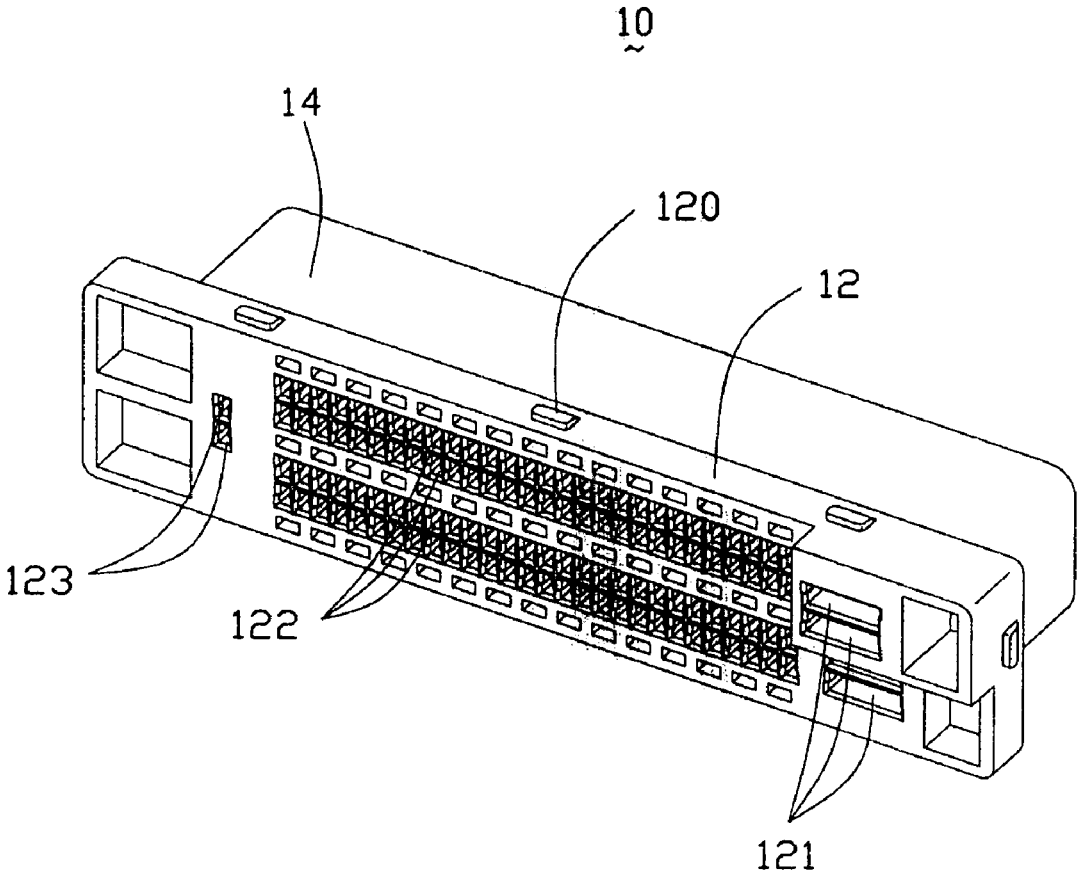
FIG. 3 is another perspective view of the insulative housing shown in FIG. 2.
Figure 6:
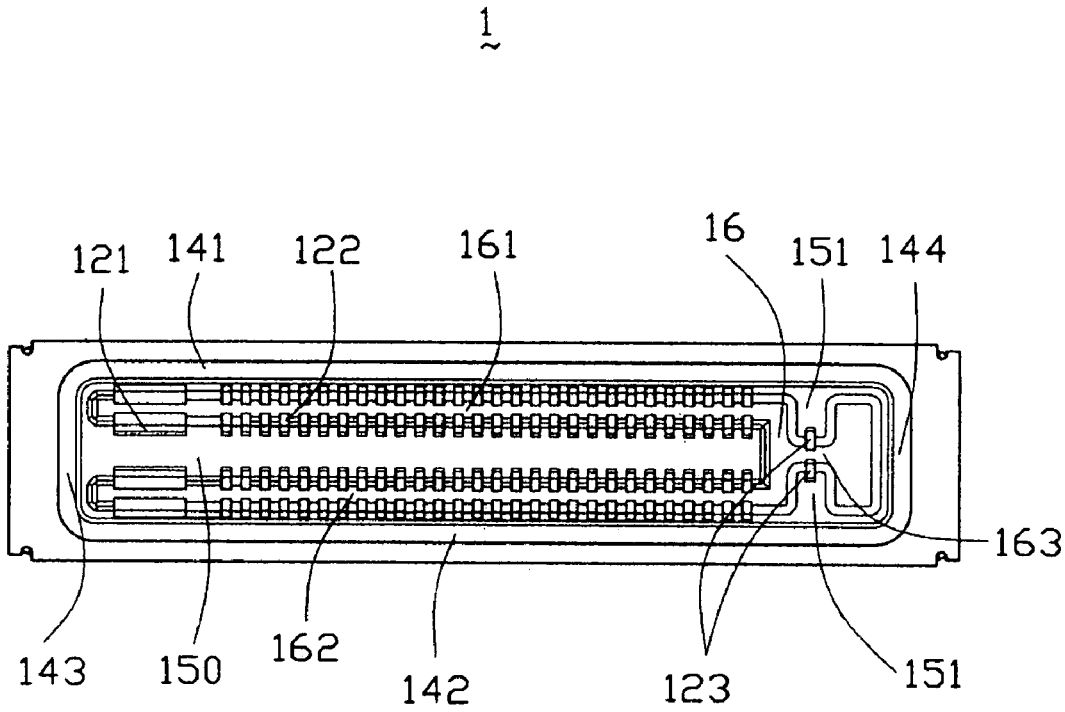
FIG. 6 is a front elevational view of the electrical connector show in FIG. 1.

With reference to FIGS. 2 and 3 and 6, the insulative housing 10 comprises a base portion 12 and a mating portion 14 extending from the base portion 12 forwardly. The mating portion 14 comprises a receiving slot 16, and a pair of opposite side walls 141, 142, and a pair of lateral wall 143, 144 surrounding the receiving slot 16. A tongue 150 is defined in the center of the receiving slot 16, and divides the receiving slot 16 into a first receiving slot 161 and a second receiving slot 162. The tongue 150 connects with the lateral wall 143 of the mating portion 14 at one end, and is separated with the other lateral wall 144 of the mating portion 14 at the other end. The end of the tongue and the lateral wall 144 form a recess together. A pair of blocks 151 respectively extend from the opposite side walls 141, 142 into the recess 163 in a vertical direction, and are aligned with each other. Thus, the pair of blocks 151 are positioned between the tongue 150 and the lateral wall 144 of the mating portion 14 in a vertical direction. The blocks 151 and the lateral wall 144 define a guiding channel 152 therebetween. The insulative housing 10 further comprises a plurality of terminal channels extending from the base portion 12 to the mating portion 14. The terminal channels comprise four first terminal channels 121, a plurality of second terminal channels 122 and a pair of third terminal channels 123. The first and second terminal channels 121, 122 are defined in the tongue 150, the opposite side walls 141, 142, respectively. The third terminal channels 123 are positioned on the blocks 151. The first terminal channel 121 has a larger width than that of the second and third terminal channels 122, 123 which have the same width as each other. The base portion 12 further comprises a plurality of projections 120 spaced arranged on a peripheral thereof.

Figure 5:
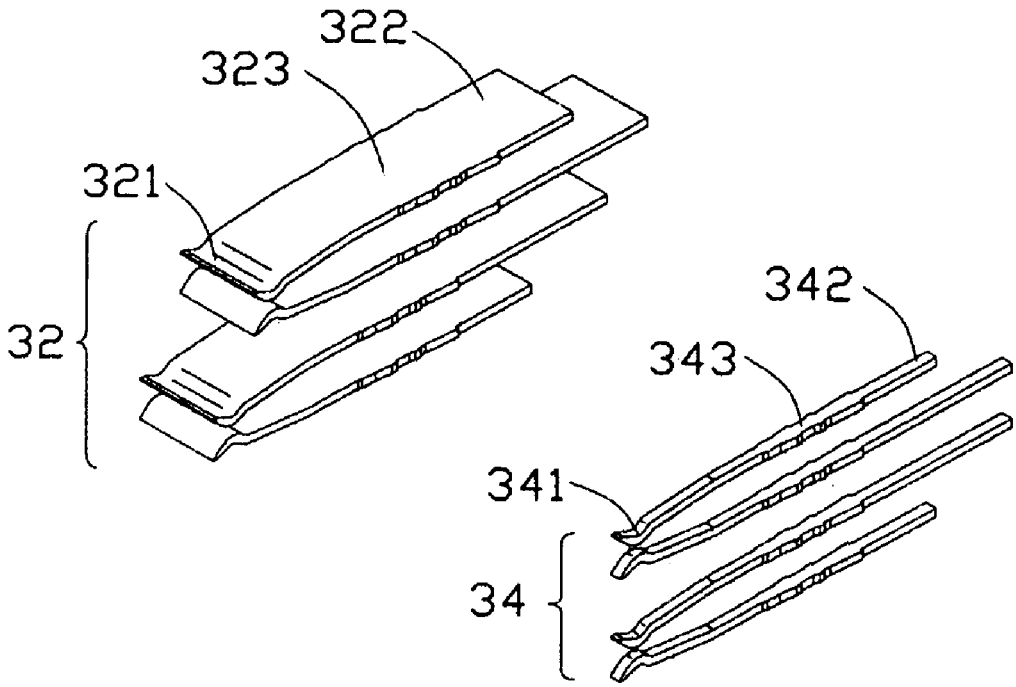
FIG. 5 is a perspective view of contacts of the electrical connector shown in FIG. 1.

Reference with FIG. 5, the terminals 30 comprise a plurality of first terminals 32 and a plurality of second terminals 34. The terminals 30 comprise a tail portion 322, 342, a contacting portion 321, 341 and a retaining portion 323, 343 connecting with the tail portion 322, 342 and the contacting portion 321, 341. Each tail portion 322, 342 is exposed beyond the insulative housing 10, and each contacting portion 321, 341 is positioned on the mating portion 14 of the insulative housing 10. The first terminals 32 are received in the first terminal channels 121, and the second terminals 34 are received in the second and third terminal channels 122, 123. The first terminal 32 is wider than the second terminal 34.

Figure 4:
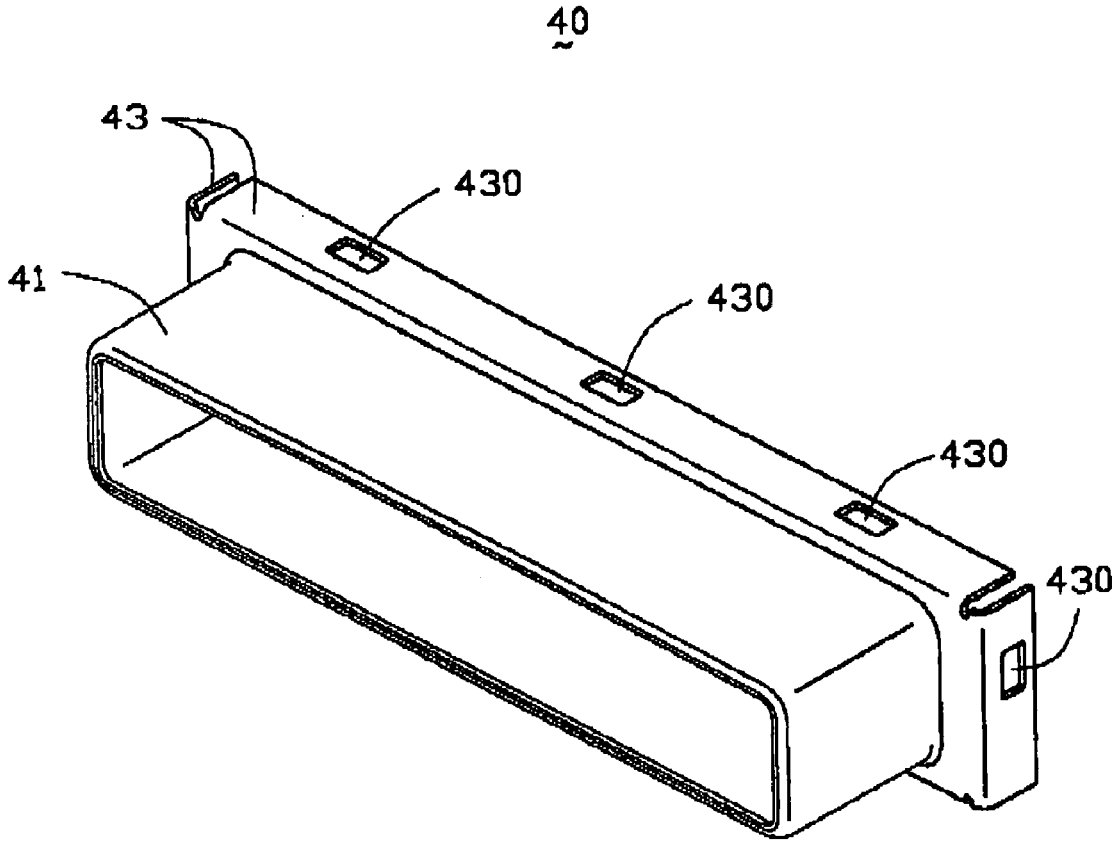
FIG. 4 is a perspective view of a shell of the electrical connector shown in FIG. 1.

Reference with FIG. 4, the shell 40 comprises a frame portion 41 and a shroud portion 43 bent from the frame portion 41. The frame portion 41 encloses the mating portion 14 of the insulative housing 10, and the shroud portion 43 encloses the base portion 12 and forms a plurality of cutouts 430 corresponding to the projections 120 of the base portion 12.

During assembly, the terminals 30 are inserted into the terminal channels from the rear portion of the base portion 12 along a back-to-front direction. The shell 40 is assembled on the insulative housing 10, and with the cutouts 430 thereof engaging with corresponding projections 120 for retaining the shell 40 on the insulative housing 10.

The terminals 30 positioned on the blocks 151 transmit different signals with the terminals 30 positioned on the tongue 150. Because the blocks 151 separate the terminals 30 transmitting different signals, the interference between the terminals 30 is decreasing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

an insulative housing defining a mating portion, and a receiving slot extending forming in the mating portion, the insulative housing defining thereof longitudinal and transverse directions perpendicular to each other;

a tongue formed in the receiving slot and dividing the receiving slot into a first receiving slot and a second receiving slot;

a plurality of terminals being received in the opposite sides of the tongue and a pair of opposite side walls; and at least a first block extending vertically from one of the opposite side walls into the receiving slot adjacent to the first receiving slot;

wherein the tongue connects with one lateral wall of the housing and spaced from the other lateral wall opposite to said one lateral wall along said longitudinal direction.

2. The electrical connector as described in claim 1, further comprising a second block extending from the other opposite side walls of the mating portion.

3. The electrical connector as described in claim 2, wherein at least a terminal positioned on the block.

4. The electrical connector as described in claim 1, wherein the block and said lateral wall of the mating portion define a guiding channel.

5. The electrical connector as described in claim 1, wherein the insulative housing comprises a base portion, and wherein the base portion defines a plurality terminal channels extending to the mating portion for receiving corresponding terminals.

6. The electrical connector as described in claim 5, wherein the terminal channels comprise a plurality of first channels, a plurality of second channels and third channels, the first and the second channels extend from the base portion of the insulative housing to the opposite-side walls of the mating portion and the tongue, the third channel extends from the base portion to the block.

7. The electrical connector as described in claim 6, wherein the terminals comprise a plurality of first and second terminals, each of the first and second terminals comprises a contacting portion, a tail portion and a retaining portion between the contacting portion and the tail portion, each first terminal is wider than each second terminal.

8. The electrical connector as described in claim 7, wherein the first terminals are received in the first terminal channels, the second terminals are received in the second and the third terminal channels, the retaining portions of the terminals are retained in the base portion, the tail portion of the terminals are exposed beyond the insulative housing, the contacting portions of the terminals received in the first and second channels are positioned in the opposite side walls and the tongue, the contacting portion of the terminal received in the third terminal channel is positioned on the blocks.

9. The electrical connector as described in claim 1, further comprising a shell enclosing the insulative housing.

10. The electrical connector as described in claim 9, wherein the shroud portion of the shell comprises a plurality of cutouts, and the base portion of insulative housing comprises a plurality of projections, each projection engages with a corresponding cutout for retaining the shell on the insulative housing.

11. An electrical connector, comprising:

an insulative housing having a base portion defining a mating portion, the insulative housing defining thereof longitudinal and transverse directions perpendicular to each other;

a first receiving slot defined in the mating interface and extending into the base portion;

a second receiving slot defined adjacent to the first receiving slot and extending into the base portion;

each of the first and second receiving slots assembled with terminals;

a recess in communication with the first and second receiving slots; and at least a block extending from a first side wall of the recess and adjacent to one of the receiving slot;

wherein the tongue connects with one lateral wall of the housing and spaced from the other lateral wall opposite to said one lateral wall along said longitudinal direction.

12. The electrical connector as described in claim 11, further comprising a second block extending from an opposite side wall of the recess.

13. The electrical connector as described in claim 11, wherein the first receiving slot and the second receiving slot are divided by a tongue defining in the mating interface.

14. The electrical connector as described in claim 11, wherein at least a terminal is positioned on the block.

15. The electrical connector as described in claim 11, further comprising a shell enclosing the insulative housing.

16. The electrical connector as described in claim 15, wherein the shell comprises a frame portion, and a shroud portion bent from the frame portion.

17. An electrical connector comprising:

an insulative housing defining thereof longitudinal and transverse direction perpendicular to each other;

a receiving slot defined in the housing;

a mating tongue horizontally extending in a mid-level of said receiving slot;

a plurality of terminals mounted on the mating tongue; and a pair of opposite blocks formed in one longitudinal end of the receiving slot; wherein said tongue extends along said longitudinal direction toward said longitudinal end but terminates before reaches said longitudinal end, and thus said pair of blocks are spaced from the mating tongue with a distance in said longitudinal direction and offset from the mating tongue along said transverse direction.

18. The electrical connector as claimed in claim 17, wherein a pair of contacts are located on the blocks, respectively, and wherein the terminals extend away from said mid-level while the contacts extends toward the mid-level.

19. The electrical connector as claimed in claim 17, wherein due to said pair of blocks, said longitudinal end of the receiving slot defines a sandglass-like configuration for polarization.

20. The electrical connector as claimed in claim 17, wherein said tongue is connected to the other longitudinal end in said longitudinal direction.

* * * * *